US007576492B2

(12) United States Patent
Kim et al.

(10) Patent No.: US 7,576,492 B2
(45) Date of Patent: Aug. 18, 2009

(54) PLASMA DISPLAY PANEL WITH REDUCED CAPACITANCE BETWEEN ADDRESS ELECTRODES

(75) Inventors: Jeong-Nam Kim, Suwon-si (KR); Tae-Ho Lee, Suwon-si (KR); Yon-Goo Park, Suwon-si (KR); Min-Sun Yoo, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 467 days.

(21) Appl. No.: 11/099,531

(22) Filed: Apr. 6, 2005

(65) Prior Publication Data

US 2005/0225246 A1 Oct. 13, 2005

(30) Foreign Application Priority Data

Apr. 7, 2004 (KR) ..... 10-2004-0023728

(51) Int. Cl.
*H01J 17/49* (2006.01)

(52) U.S. Cl. ..... 313/586; 313/587

(58) Field of Classification Search ..... 313/581–587; 345/60; 445/23

See application file for complete search history.

(56) References Cited

U.S. PATENT DOCUMENTS

| | | | | |
|---|---|---|---|---|
| 5,182,489 | A | 1/1993 | Sano | 313/485 |
| 5,841,232 | A | 11/1998 | Hirao et al. | 313/585 |
| 6,373,195 | B1 | 4/2002 | Whang et al. | 315/169.3 |
| 6,376,986 | B1 | 4/2002 | Takagi et al. | 313/582 |
| 6,667,581 | B2 * | 12/2003 | Ahn | 315/169.4 |
| 2001/0054871 | A1 * | 12/2001 | Tadaki et al. | 313/586 |
| 2003/0034734 | A1 * | 2/2003 | Kim et al. | 313/582 |

FOREIGN PATENT DOCUMENTS

| | | | |
|---|---|---|---|
| JP | 06-044907 | | 2/1994 |
| JP | 2003-016944 | * | 1/2003 |
| JP | 2003016944 | | 1/2003 |
| KR | 1020010090944 | | 10/2001 |

* cited by examiner

*Primary Examiner*—Joseph L Williams
*Assistant Examiner*—Fatima N Farokhrooz
(74) *Attorney, Agent, or Firm*—H.C. Park & Associates, PLC

(57) ABSTRACT

A plasma display panel including a first substrate and a second substrate opposing one another with a predetermined gap therebetween, address electrodes formed along a first direction on the first substrate, and barrier ribs mounted in the gap between the first and second substrates and defining a plurality of discharge cells. First electrodes and second electrodes are formed on the second substrate along a second direction, which crosses the first direction. The address electrodes include expanded segments with an enlarged width in areas corresponding to the discharge cells, and indented segments that are indented at areas corresponding to gaps between the first electrodes and the second electrodes.

19 Claims, 5 Drawing Sheets

PLASMA DISPLAY PANEL WITH REDUCED CAPACITANCE BETWEEN ADDRESS ELECTRODES

CROSS REFERENCE TO RELATED APPLICATION

This application claims priority to and the benefit of Korean Patent Application No. 10-2004-0023728, filed on Apr. 7, 2004, which is hereby incorporated by reference for all purposes as if fully set forth herein.

BACKGROUND OF THE INVENTION

1. Field of the Invention

The present invention relates to a plasma display panel (PDP), and more particularly, to a PDP having address electrodes that may consume less power during address discharge.

2. Description of the Background

A PDP displays images through plasma discharge. That is, applying a voltage between electrodes may generate a gas discharge that emits ultraviolet rays that excite phosphors, thereby displaying images. The PDP may offer many advantages over other display configurations including superior display capacity, brightness, and contrast, as well as a wide viewing angle. Consequently, the PDP is widely popular.

Depending on the arrangement of red (R), green (G), and blue (B) discharge cells, the PDP may be a stripe-type PDP, where the discharge cells are arranged in lines of the same color, or a delta-type PDP, where the discharge cells are grouped into a triangular configuration.

U.S. Pat. No. 5,182,489 (rectangular closed-type barrier ribs), Japanese Laid-Open Patent No. Heisei 6-44907 (hexagonal closed-type barrier ribs), and U.S. Pat. Nos. 6,373,195 and 6,376,986 (linear barrier ribs) disclose delta-type PDPs. U.S. Pat. No. 5,841,232 discloses a stripe-type PDP.

PDPs may be similarly driven, regardless of the type of barrier rib structure utilized. Namely, in stripe-type and delta-type PDPs, address electrodes may be formed on a rear substrate at locations corresponding to each discharge cell, and scan electrodes and sustain electrodes may be formed on a front substrate. Applying an address voltage between the address electrodes and the scan electrodes addresses corresponding discharge cells, and then applying a sustain voltage between the sustain electrodes and the scan electrodes displays images.

Generally, increased capacitance is a common drawback of PDPs. In particular, increasing the PDP's resolution requires more discharge cells. However, more discharge cells reduces a gap between address electrodes, which increases capacitance due to the effect of the gap on power consumption during address discharge. That is, the address electrode gap is inversely proportional to capacitance. An increase in capacitance adversely affects the PDP's operational characteristics. This may be particularly so with the delta-type PDP.

Further, a method of scanning the scan electrodes during the address period may change from a dual scan method (simultaneous scanning of upper and lower regions of the screen) to a single scan method (scanning starting from either the upper or lower region of the screen), which doubles the length of the address electrodes. Consequently, capacitance between address electrodes increases, as does frequency, thereby increasing power consumption. That is, capacitance is proportional to address electrode length, and power consumption is proportional to capacitance and frequency. Hence, increases in address electrode length and frequency may result in greater power consumption.

SUMMARY OF THE INVENTION

The present invention provides a PDP having reduced capacitance between address electrodes, thereby minimizing power consumption.

Additional features of the invention will be set forth in the description which follows, and in part will be apparent from the description, or may be learned by practice of the invention.

The present invention discloses a PDP comprising a first substrate and a second substrate opposing one another with a first gap therebetween, an address electrode formed on the first substrate along a first direction, barrier ribs in the first gap and defining a plurality of discharge cells, and a first electrode and a second electrode formed on the second substrate along a second direction, which is substantially perpendicular to the first direction. The address electrode includes an expanded segment in an area corresponding to a discharge cell and an indented segment in an area corresponding to a second gap between the first electrode and the second electrode.

The present invention also discloses a display panel comprising a first substrate and a second substrate opposing one another, an address electrode formed on the first substrate and along a first direction, a plurality of discharge cells, and display electrodes formed on the second substrate and along a second direction. The address electrode includes an expanded segment in an area corresponding to a discharge cell, and the expanded segment includes an indented segment. A portion of the indented segment is not overlapped by the display electrodes.

The present invention also discloses a PDP comprising a first substrate, an address electrode formed on the first substrate, a dielectric layer covering the address electrode, and barrier ribs formed on the dielectric layer and defining a plurality of discharge cells. The address electrode is formed in a first area corresponding to a discharge cell and in a second area under a barrier rib, and a permittivity of the dielectric layer in the first area differs from a permittivity of the dielectric layer in the second area.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE ILLUSTRATED EMBODIMENTS

Exemplary embodiments of the present invention will now be described with reference to the drawings.

Figure 1:
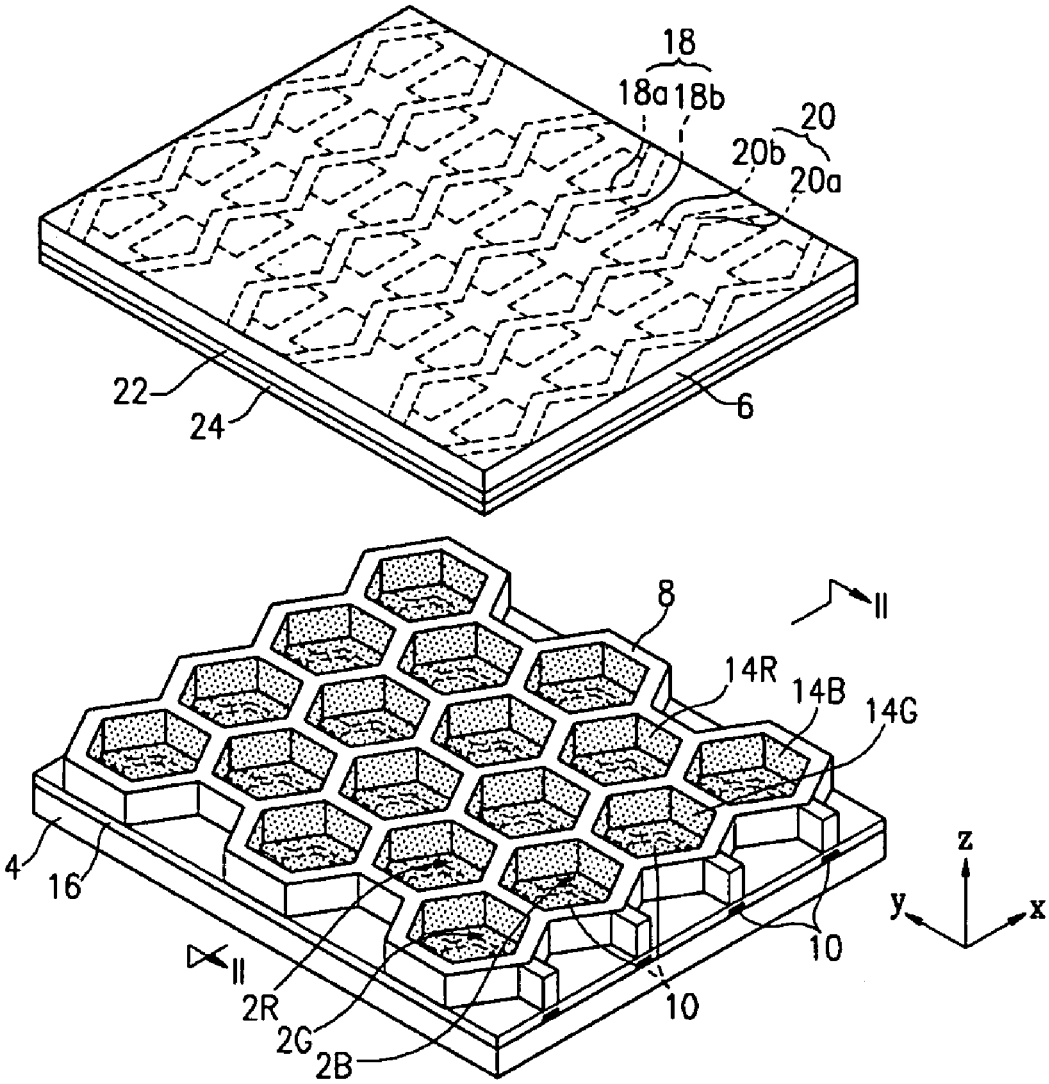
FIG. 1 is a partial exploded perspective view showing a PDP according to an exemplary embodiment of the present invention.
Figure 2:
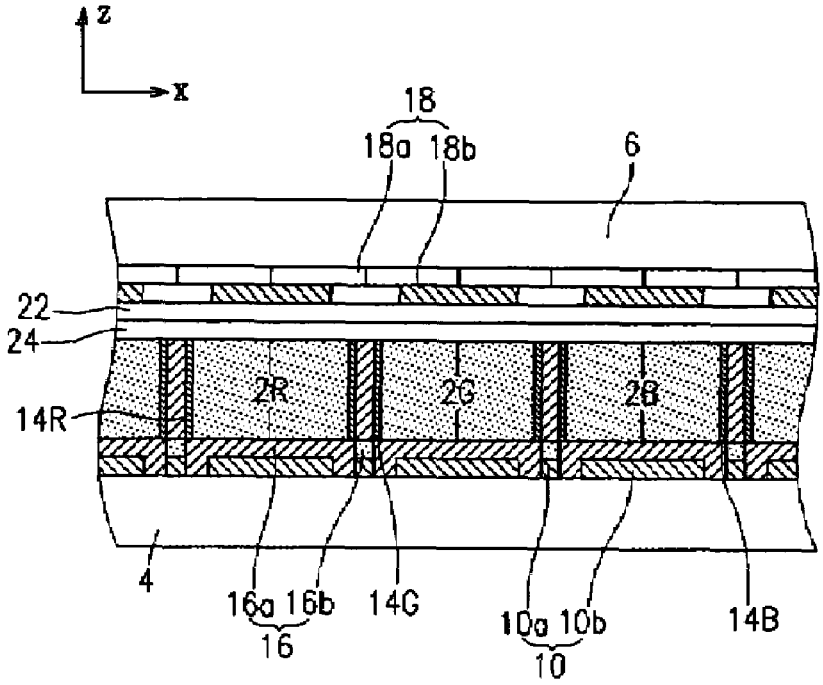
FIG. 2 is a partial sectional view showing the PDP of FIG. 1 as assembled.
Figure 3:
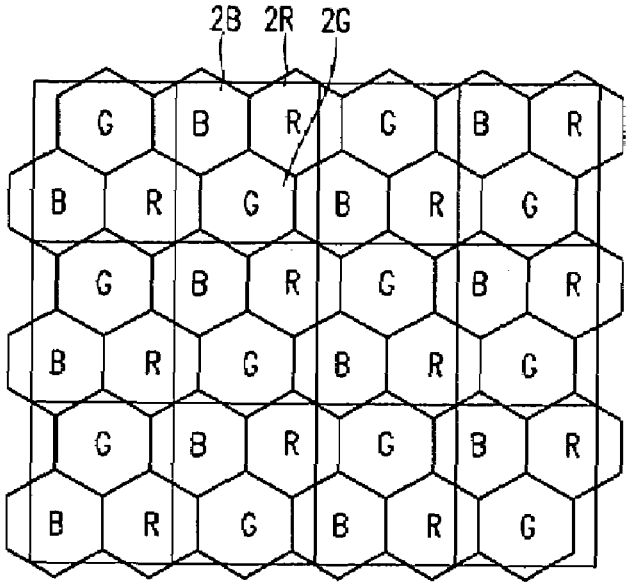
FIG. 3 is a schematic plan view showing a pixel arrangement of the PDP of FIG. 1.

FIG. 1 is a partial exploded perspective view showing a PDP according to an exemplary embodiment of the present invention, FIG. 2 is a partial sectional view showing the PDP of FIG. 1, as assembled, and FIG. 3 is a schematic plan view showing a pixel arrangement of the PDP of FIG. 1.

Referring to FIG. 1, FIG. 2 and FIG. 3, discharge cells 2R, 2G, 2B may be arranged in a delta configuration. That is, three discharge cells comprising a red discharge cell 2R, a green discharge cell 2G, and a blue discharge cell 2B are provided in a triangular configuration to form a pixel.

The PDP may include a first substrate 4 and a second substrate 6 provided substantially parallel to one another with a predetermined gap therebetween. Barrier ribs 8 may be formed in a predetermined pattern between the first substrate 4 and the second substrate 6 to thereby define the pixels, where each pixel comprises three subpixels, (i.e. three discharge cells 2R, 2G, 2B). In the exemplary embodiment, the barrier ribs 8 define discharge cells 2R, 2G, 2B having a hexagonal planar shape.

A discharge gas may be filled in the hexagonal spaces defined by the discharge cells 2R, 2G, 2B. Further, red, green, and blue phosphor layers 14R, 14G, 14B may be formed in the discharge cells 2R, 2G, 2B, respectively. The phosphor layers 14R, 14G, 14B may be deposited on a bottom surface of the discharge cells 2R, 2G, 2B, as well as on side walls of the barrier ribs 8.

Address electrodes 10 may be formed on a surface of the first substrate 4 opposing the second substrate 6 and along a first direction (i.e., direction y in the drawings). A first dielectric layer 16 may cover the address electrodes 10.

In the exemplary embodiment, the first dielectric layer 16 includes first dielectric regions 16*a* and second dielectric regions 16*b*, which have different permittivities. The first dielectric regions 16*a* may be formed at areas corresponding to the discharge cells 2R, 2G, 2B, while the second dielectric regions 16*b* may be formed under the barrier ribs 8 where discharge does not take place.

As noted above, power consumption is proportional to a capacitance between the address electrodes 10, and this capacitance, in turn, is proportional to permittivity. Hence, in order to reduce the PDP's power consumption, the permittivity of the second dielectric regions 16*b* may be less than the permittivity of the first dielectric regions 16*a*, which reduces the capacitance between the address electrodes 10. Further, the first dielectric regions 16*a* and the second dielectric regions 16*b* respectively may have the same width as the address electrodes.

Alternatively, the dielectric layer 16 may be formed having varying thicknesses, which varies its capacitance. In this case, the first dielectric regions 16*a* may be thinner than the second dielectric regions 16*b*.

Although the first and second dielectric regions 16*a*, 16*b* are shown as one layer in FIG. 2, a multi-layered structure may provide the dielectric layer 16 with different permittivities, i.e., different capacitances.

The dielectric layer 16 may be made using PbO, $SiO_2$, $B_2O_3$, $Al_2O_3$, $TiO_2$, and other such compounds as its base material. Since PbO and $SiO_2$ may determine the dielectric layer's permittivity, suitably adjusting their amounts in different areas of the layer varies the layer's permittivity. That is, since PbO has a high permittivity, and $SiO_2$ has a low permittivity, the second dielectric regions 16*b* may contain less PbO or more $SiO_2$ than the first dielectric regions 16*a*.

The address electrodes 10 may be formed corresponding to the shape of the discharge cells 2R, 2G, 2B, and predetermined gaps are provided between adjacent address electrodes.

Figure 4A:
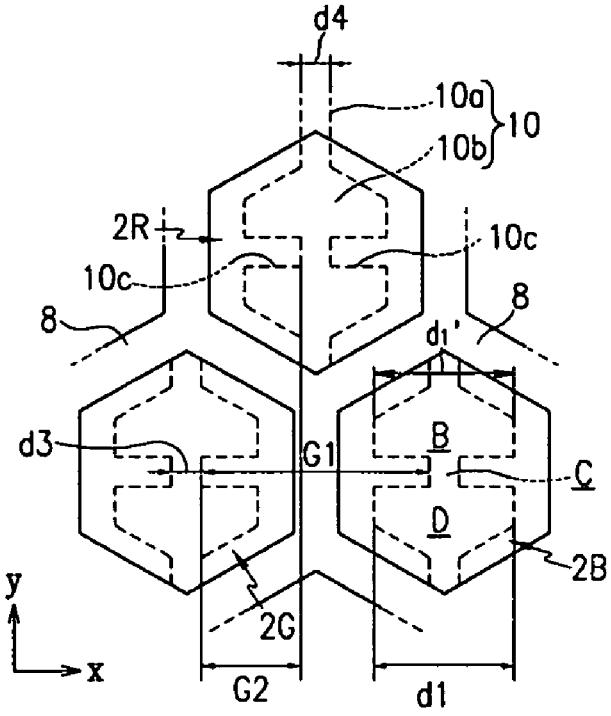
FIG. 4A is a partial plan view showing the PDP of FIG. 1.
Figure 4B:
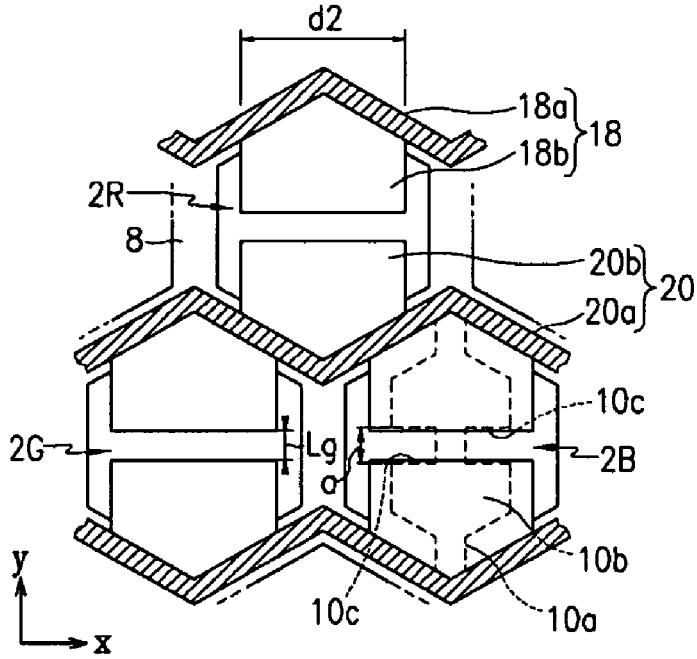
FIG. 4B is a partial plan view showing the PDP of FIG. 1.

Referring to FIG. 4A and FIG. 4B, the address electrodes 10 may include line segments 10*a*, which may be formed along direction y and under the barrier ribs 8, and expanded segments 10*b*, which may be positioned at areas corresponding to the discharge cells 2R, 2G, 2B. A width $d_{1'}$ or $d_1$ of the expanded segments 10*b* along a second direction (i.e., direction x in the drawings) may be greater than a width $d_4$ of the line segments 10*a*. The expanded segments 10*b* may be formed substantially in a hexagonal shape corresponding to the shape of the discharge cells 2R, 2G, 2B. The shape of the address electrodes 10 will be described in more detail below.

Referring to FIG. 1, FIG. 2, and FIG. 4B, first electrodes 18 (X electrodes) and second electrodes 20 (Y electrodes) may be formed on a surface of the second substrate 6 opposing the first substrate 4. The X electrodes 18 and the Y electrodes 20 may be formed along direction x. Further, the X and Y electrodes 18, 20 may include bus electrodes 18*a*, 20*a* and protruding electrodes 18*b*, 20*b*, respectively. The bus electrodes 18*a*, 20*a* may be formed corresponding to the shape of the barrier ribs 8 along direction x, and the protruding electrodes 18*b*, 20*b* protrude from the bus electrodes 18*a*, 20*a* along direction y toward centers of the discharge cells 2R, 2G, 2B, such that a protruding electrode 18*b* and a protruding electrode 20*b* oppose one another in areas corresponding to each discharge cell 2R, 2G, 2B.

The bus electrodes 18*a*, 20*a* may be made of a non-transparent material such as metal, and they may be mounted over, and corresponding to, the shape of the barrier ribs 8 along direction x. Hence, the bus electrodes 18*a*, 20*a* may have a zigzag shape. The bus electrodes 18*a*, 20*a* may also be formed as narrow as possible so they do not block visible light emitted from the discharge cells 2R, 2G, 2B. The protruding electrodes 18*b*, 20*b* may be made of a transparent material such as indium tin oxide (ITO).

A second dielectric layer 22 may cover the X electrodes 18 and the Y electrodes 20, and a protection layer 24, which may be made of MgO or other like materials, may cover the second dielectric layer 22.

In the exemplary embodiment, the configuration of the expanded segments 10*b* of the address electrodes 10 increases gaps between address electrodes 10, ultimately decreasing the PDP's power consumption. Formula 1, which provides capacitance, shows that if the electrode gap increases, capacitance, which is inversely proportional to electrode gap, decreases. Power consumption may also decrease due to the linear relation between power consumption and capacitance.

$$C = \varepsilon \frac{A}{d} \qquad \text{[Formula 1]}$$

where C is the capacitance between the address electrodes, d is the gap between the address electrodes 10, A is the area between the address electrodes, and $\epsilon$ is the permittivity between the electrodes.

Referring again to FIG. 4A and FIG. 4B, the address electrodes 10 may include the expanded segments 10*b* with an overall hexagonal shape corresponding to the shape of the discharge cells 2R, 2G, 2B as described above. The expanded segments 10*b* may also be formed in the gap between the X electrodes 18 and the Y electrodes 20. Further, the expanded segments 10*b* may have a pair of indented segments 10*c* formed by removing opposite portions of the expanded segments 10*b* at areas corresponding to the centers of the discharge cells 2R, 2G, 2B, thereby reducing a width of the expanded segments 10*b* at these areas. Since the area of the address electrodes 10 affects a drive margin of an address voltage, gaps G1, G2 between the address electrodes 10 may be increased while limiting variations in their shape. Accordingly, the indented segments 10*c* may be formed where the address electrodes 10 do not overlap with the X electrodes 18 and the Y electrodes 20. In the exemplary embodiment, the indented segments 10*c* are formed between the protruded electrodes 18*b*, 20*b* of the X and Y electrodes 18, 20 (second region C in FIG. 4A). The indented segments 10*c* may be formed such that their width (a in FIG. 4B) along direction y is equal to or greater than a distance Lg between opposing pairs of the protruding electrodes 18*b*, 20*b*.

Figure 5:
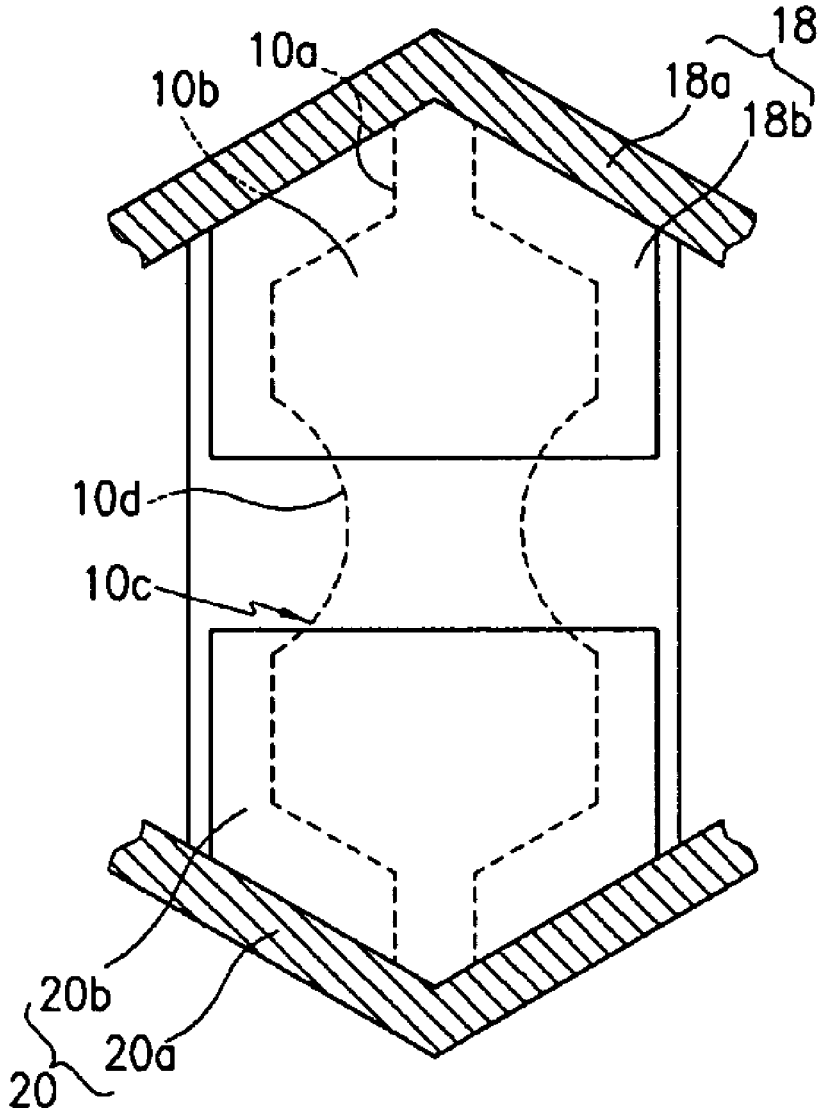
FIG. 5 is a partial plan view showing a unit discharge cell of a PDP according to another exemplary embodiment of the present invention.

The indented segments 10*c* shown in FIG. 4A and FIG. 4B are rectangular cutout sections of the expanded segments 10*b*. However, as FIG. 5 shows, the indented segments 10*c* may have a rounded shape, thereby forming arcs 10*d*. In this case, centers of the arcs 10*d* may be closer to the X electrodes 18 than the Y electrodes 20.

As FIGS. 4A and 4B show, the expanded segments 10*b* may be divided into a first region B, which is adjacent to the X electrodes 18, the second region C, which is between the X electrodes 18 and the Y electrodes 20, and a third region D, which is adjacent to the Y electrodes 20. Taken along direction x, a width $d_{1'}$ of the first region B and a width $d_1$ of the third region D may be less than a width $d_2$ of the protruding electrodes 18*b*, 20*b*. Further, a width $d_3$ of the second region C may be 20 μm or greater.

Further, the width $d_{1'}$ of the protruding electrodes 18*b* may be equal to or less than the width $d_1$ of the protruding electrodes 20*b*. This increases the discharge regions D between the Y electrodes 20 and the address electrodes 10, thereby enabling easier address discharge while reducing mis-discharge (i.e., a discharge between an X electrode and an address electrode) in the address period.

Forming the indented segments 10*c* significantly increases the gap G1 between address electrodes 10 of adjacent discharge cells. Further, the indented segments 10*c* also increase the gap G2 between address electrodes 10 of diagonally adjacent discharge cells. The increased gaps G1, G2 reduce address electrode capacitance.

Figure 6:
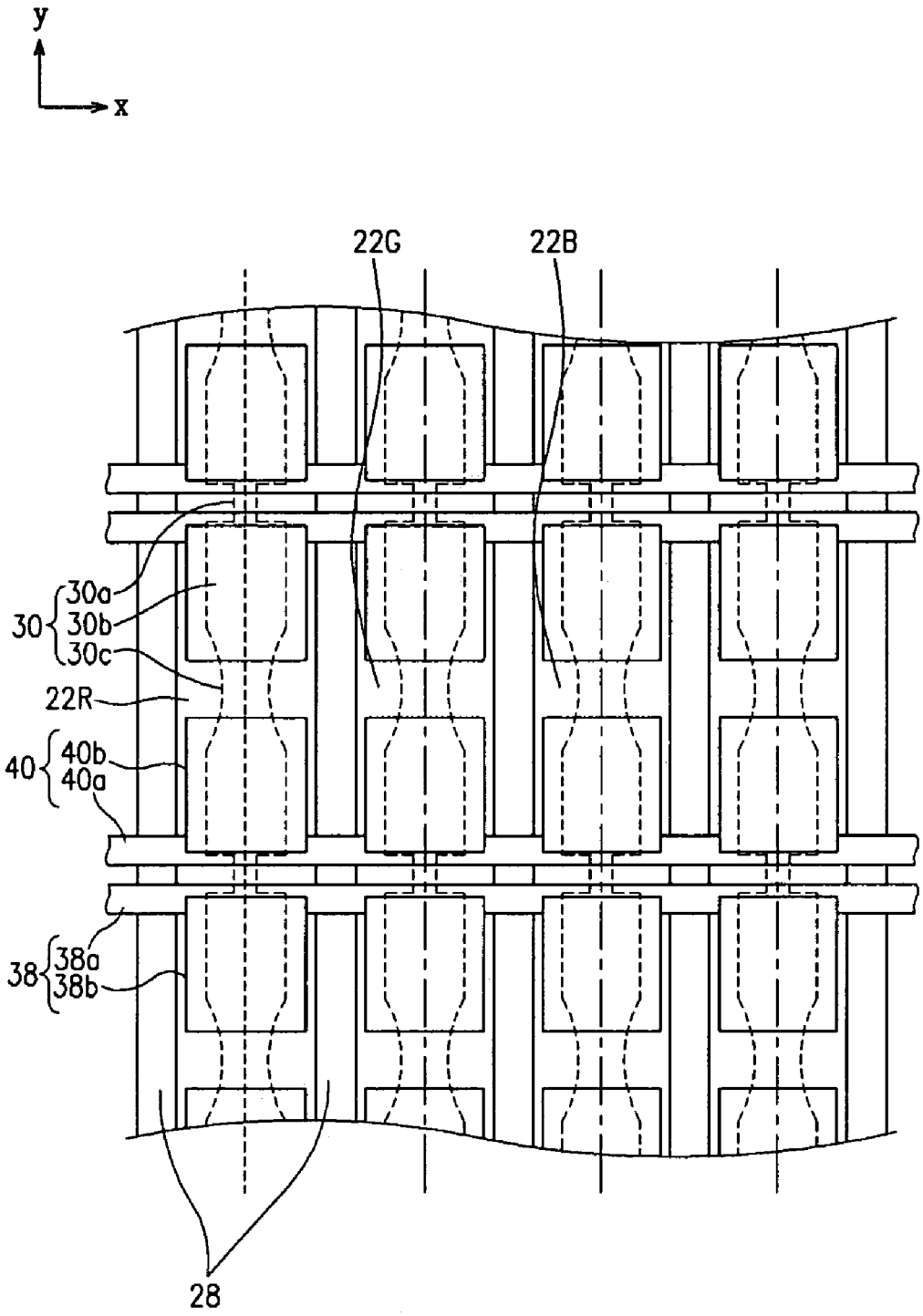
FIG. 6 is a partial plan view showing a PDP according to yet another exemplary embodiment of the present invention.

FIG. 6 shows an exemplary embodiment of the present invention applied to a stripe-type PDP. Discharge cells 22R, 22G, 22B may be defined by barrier ribs 28, which are formed in a lattice pattern by intersecting horizontal barrier ribs and vertical barrier ribs.

Address electrodes 30 may include expanded segments 30*b* at areas corresponding to the discharge cells 22R, 22G, 22B. In this exemplary embodiment, since the discharge cells 22R, 22G, 22B are substantially rectangular, the expanded segments 30*b* may also have a substantially rectangular shape.

Further, centers of the expanded segments 30*b* may be indented along direction x to form indented segments 30*c*. The shape of the indented segments 30*c* preferably is determined based on the conditions of the above embodiments. Also, the indented segments 30*c* may be rounded as shown, or they may be angled. The X and Y electrodes 38 and 40, as well as their bus electrodes 38*a*, 40*a* and protruded electrodes 38*b*, 40*b*, respectively, may be formed with similar conditions as the X and Y electrodes 18 and 20.

While exemplary embodiments of the present invention are shown and described in relation to a PDP, the address electrodes of the present invention are not limited thereto. They may be formed in a display panel having opposing substrates with address electrodes on one substrate and display electrodes on another.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display panel, comprising:

a first substrate and a second substrate opposing one another with a first gap there between;

an address electrode formed on the first substrate along a first direction;

barrier ribs in the first gap and defining a plurality of discharge cells;

a dielectric layer covering the address electrode, the dielectric layer formed between the address electrode and the barrier ribs; and a first electrode and a second electrode formed on the second substrate along a second direction intersecting the first direction, wherein the address electrode includes an expanded segment in an area corresponding to a discharge cell and an indented segment in an area corresponding to a second gap between the first electrode and the second electrode, wherein the dielectric layer has a first dielectric region and a second dielectric region formed with differing permittivities, wherein the address electrode further includes a line segment coupling expanded segments, and wherein the first dielectric region covers the expanded segment and the second dielectric region covers the line segment.

2. The plasma display panel of claim 1, wherein a third gap between adjacent address electrodes is at a maximum between indented segments.

3. The plasma display panel of claim 1, wherein the indented segment is formed in an area substantially corresponding to a center of the discharge cell.

4. The plasma display panel of claim 1, wherein the expanded segment includes a first portion opposing the first electrode and a second portion opposing the second electrode, wherein a scan voltage is applied to the second electrode in an address period, and wherein the second portion is at least as wide as the first portion.

5. The plasma display panel of claim 1, wherein the first electrode and the second electrode respectively include a bus electrode formed along the second direction and a protruding electrode protruded from the bus electrode toward a center of the discharge cell, and wherein the second gap is formed by the protruding electrode of the first electrode and the protruding electrode of the second electrode.

6. The plasma display panel of claim 1, wherein the indented segment is rounded.

7. The plasma display panel of claim 1, wherein the indented segment is angled.

8. The plasma display panel of claim 1, wherein the discharge cells are arranged in a delta configuration comprising one discharge cell having a red phosphor layer, one discharge cell having a green phosphor layer, and one discharge cell having a blue phosphor layer forming a pixel.

9. The plasma display panel of claim 1, wherein a permittivity of the second dielectric region is less than a permittivity of the first dielectric region.

10. The plasma display panel of claim 1, wherein the indented segment is positioned substantially at a center of the discharge cell.

11. The plasma display panel of claim 1, wherein the expanded segment includes a first portion opposing the first electrode and a second portion opposing the second electrode, wherein a scan voltage is applied to the second electrode in an address period, and wherein the second portion is at least as wide as the first portion.

12. The plasma display panel of claim 1, wherein the first electrode and the second electrode respectively include a bus electrode formed along the second direction and a protruding electrode protruded from the bus electrode toward a center of the discharge cell, and wherein the second gap is formed by the protruding electrode of the first electrode and the protruding electrode of the second electrode.

13. The plasma display panel of claim 5, wherein the expanded segment is not wider than the protruding electrode of the first electrode and the protruding electrode of the second electrode.

14. The plasma display panel of claim 6, wherein the indented segment is formed as an arc, wherein a center of the arc is closer to the first electrode, and wherein a scan voltage is applied to the second electrode during an address period.

15. The plasma display panel of claim 9, wherein the first dielectric region and the expanded segment are equally wide, and wherein the second dielectric region and the line segment are equally wide.

16. The plasma display panel of claim 12, wherein the expanded segment is not wider than the protruding electrode of the first electrode and the protruding electrode of the second electrode.

17. A display panel, comprising:

a first substrate and a second substrate opposing one another;

an address electrode formed on the first substrate and along a first direction;

barrier ribs between the first substrate and the second substrate, the barrier ribs defining a plurality of discharge cells;

a dielectric layer covering the address electrode, the dielectric layer formed between the address electrode and the barrier ribs; and display electrodes formed on the second substrate and along a second direction;

wherein the address electrode includes an expanded segment in an area corresponding to a discharge cell, wherein the expanded segment includes an indented segment, wherein a portion of the indented segment is not overlapped by the display electrodes, wherein the dielectric layer has a first dielectric region and a second dielectric region, wherein a permittivity of the second dielectric region is less than a permittivity of the first dielectric region, wherein the address electrode further includes a line segment coupling expanded segments, and wherein the first dielectric region covers the expanded segment and the second dielectric region covers the line segment.

18. A plasma display panel, comprising:

a first substrate;

an address electrode formed on the first substrate;

barrier ribs defining a plurality of discharge cells; and a dielectric layer covering the address electrode, the dielectric layer formed between the address electrode and the barrier ribs, "wherein the dielectric layer has a first dielectric region and a second dielectric region".

wherein the address electrode is formed in a first area corresponding to a discharge cell and in a second area under a barrier rib, wherein a permittivity of the dielectric layer in the first area differs from a permittivity of the dielectric layer in the second area, wherein the address electrode further includes a line segment coupling expanded segments, and wherein the first dielectric region covers the expanded segment and the second dielectric region covers the line segment.

19. The plasma display panel of claim 18, wherein the permittivity of the dielectric layer in the second area is less than the permittivity of the dielectric layer the first area.

* * * * *

UNITED STATES PATENT AND TRADEMARK OFFICE

CERTIFICATE OF CORRECTION

PATENT NO. : 7,576,492 B2
APPLICATION NO. : 11/099531
DATED : August 18, 2009
INVENTOR(S) : Kim et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 615 days.

Signed and Sealed this

Seventh Day of September, 2010

David J. Kappos

David J. Kappos
*Director of the United States Patent and Trademark Office*